US007841898B1

(12) United States Patent
Titus

(10) Patent No.: US 7,841,898 B1
(45) Date of Patent: Nov. 30, 2010

(54) CONNECTOR ADAPTER

(75) Inventor: Jeffrey L. Titus, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/512,474

(22) Filed: Jul. 30, 2009

(51) Int. Cl.
*H01R 9/05* (2006.01)

(52) U.S. Cl. ..... 439/580

(58) Field of Classification Search ..... 439/580, 439/579, 581

See application file for complete search history.

(56) References Cited

U.S. PATENT DOCUMENTS

| | | | | |
|---|---|---|---|---|
| 2,703,863 | A | 3/1955 | Johnson | |
| 2,762,025 | A | 9/1956 | Melcher | |
| 3,613,050 | A | 10/1971 | Andrews | |
| 4,096,752 | A | 6/1978 | Tonnelli | |
| 4,173,384 | A * | 11/1979 | Phillips | 439/448 |
| 4,241,973 | A | 12/1980 | Mayer et al. | |
| 6,873,167 | B2 | 3/2005 | Goto et al. | |
| 7,029,321 | B2 * | 4/2006 | Sato et al. | 439/516 |
| 2008/0274642 | A1 | 11/2008 | Wolf | |

OTHER PUBLICATIONS

Pomona Access 90497, Model 1269 BNC (Female) to double Stacking Banana Plugs, 1 pg., May 22, 2002, also available at www.pomonaelectronics.com.

Pomona Access 90116, Model 219 Triaxial, 3 Lug Bayonet BNC Style, (F) Bulkhead Mount, 1 pg., Jun. 9, 1999, also available at www.pomonaelectronics.com.

Keithley, Model 2400 General-Purpose Source Meter w/ Measurements up to 200V and 1A, 20W Power Output, 3 pgs., as early as Jun. 12, 2009, also available at http://www.keithley.com/products/currentvoltage/?mn=2400.

Keithley, Series 2400 SourceMeter Line, Tightly Coupled Precision Sourcing and Measurement, 8 pgs., at least as early as Jun. 12, 2009, also at www.keithley.com.

SPC Technology, Schematic of a Banana Plug, 1 pg. Jul. 13, 1992.

* cited by examiner

*Primary Examiner*—Phuong K Dinh
(74) *Attorney, Agent, or Firm*—Christopher A. Monsey

(57) ABSTRACT

An exemplary electrical adapter that can be used with a triaxial cable having a center connector, a middle connector, and an outer connector as well as a method for using the same is provided. The adapter's center connector electrically couples with the cable's center conductor, the middle connector electrically couples with the cable's middle conductor, and the outer connector electrically couples with the cable's outer conductor. The adapter further includes a first single-conductor connector electrically coupled with the center connector of the triaxial connector where the first single-conductor connector can be configured to provide the center conductor of the cable at a predetermined potential. The adapter embodiment further includes a second single-conductor electrically coupled with the middle connector of the triaxial connector where the second single-conductor connector is configured to provide the middle conductor of the cable at the same potential as the center conductor of the cable.

25 Claims, 6 Drawing Sheets

CONNECTOR ADAPTER

STATEMENT REGARDING FEDERALLY SPONSORED RESEARCH OR DEVELOPMENT

The invention described herein was made in the performance of official duties by an employee of the Department of the Navy and may be manufactured, used, licensed by or for the United States Government for any governmental purpose without payment of any royalties thereon.

BACKGROUND AND SUMMARY OF THE DISCLOSURE

The present disclosure relates to an electrical adapter. More particularly, the present disclosure relates to an electrical adapter for use with a triaxial cable, and to a method for using the same.

A source measurement unit (SMU) may be used to develop and analyze a device under test (DUT). A typical SMU is able to provide precise voltage sourcing and current sourcing to the DUT. Also, a typical SMU is able to monitor voltage and current consumed by the DUT.

Known SMU's include banana jack terminals for connecting to the DUT. These banana jack terminals accommodate use of single-conductor banana cables, not triaxial (or triax) cables, which may produce less noise and leakage than banana plug cables, for example.

The present disclosure relates to an electrical adapter for coupling a triaxial cable to a device having a plurality of banana terminals, and to a method for using the same. A need for the invention was identified by the United States Navy, a search for a technical solution which met this need was conducted over time, and no technical solution was found to satisfy the needs which gave rise to this invention. Thus, this invention satisfied a long felt need.

According to an embodiment of the present disclosure, an adapter is provided for use with a triaxial cable having a center conductor, a middle conductor that surrounds the center conductor, and an outer conductor that surrounds the middle conductor. The adapter includes a triaxial connector, a first single-conductor connector, and a second single-conductor connector. The triaxial connector includes a center connector portion, a middle connector portion, and an outer connector portion, the triaxial connector configured to couple to the triaxial cable such that the center connector portion is in electrical communication with the center conductor of the triaxial cable, the middle connector portion is in electrical communication with the middle conductor of the triaxial cable, and the outer connector portion is in electrical communication with the outer conductor of the triaxial cable. The first single-conductor connector is in electrical communication with the center connector portion of the triaxial connector. The second single-conductor connector is in electrical communication with the middle connector portion of the triaxial connector.

According to another embodiment of the present disclosure, the adapter is provided with an electronic device having a first banana jack terminal and a second banana jack terminal.

According to yet another embodiment of the present disclosure, a method is provided for connecting electrical components using a triaxial cable, the triaxial cable having a center conductor, a middle conductor that surrounds the center conductor, and an outer conductor that surrounds the middle conductor. The method includes the steps of: providing an adapter including a first banana connector and a second banana connector; connecting the triaxial cable to the adapter such that the center conductor of the triaxial cable is in electrical communication with the first banana connector of the adapter and the middle conductor of the triaxial cable is in electrical communication with the second banana connector of the adapter; providing an electronic device including a first banana terminal and a second banana terminal; and connecting the adapter to the electronic device such that the first banana connector of the adapter is in electrical communication with the first banana terminal of the electronic device and the second banana connector of the adapter is in electrical communication with the second banana terminal of the electronic device.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

Figure 1:
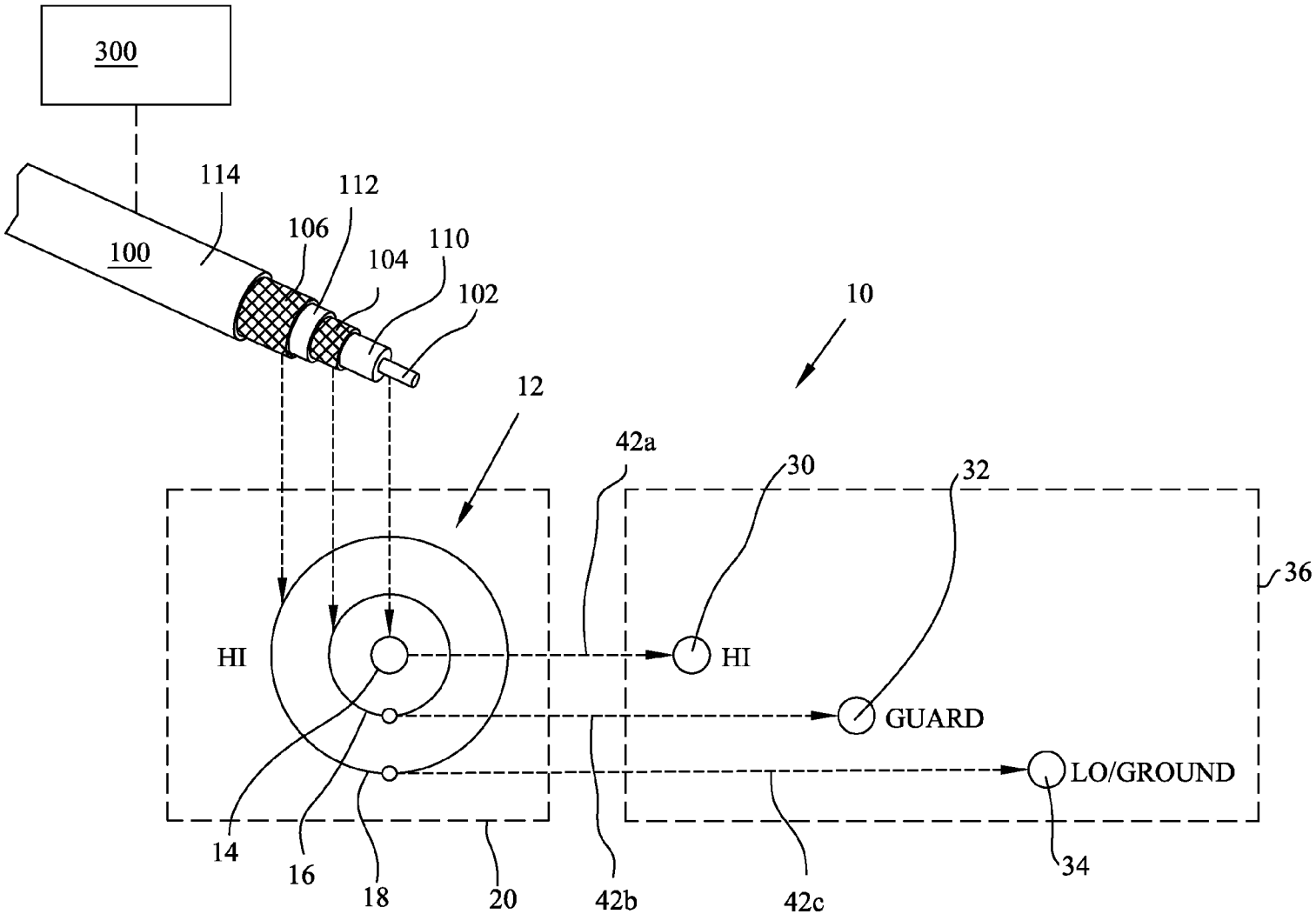
FIG. 1 is a schematic diagram of an illustrative adapter of the present disclosure coupled to a triaxial cable.

Referring to FIG. 1, an illustrative adapter 10 is provided for use with a device under test (DUT) 300 having a triaxial (or triax) cable 100. Triaxial cable 100 includes center conductor 102 (also known as a core), middle conductor 104 (also known as a guard), and outer conductor 106 (also known as a shield). Center conductor 102 is often a solid wire, as shown in FIG. 1, but center conductor 102 may also be braided. Middle conductor 104 is concentric with center conductor 102 and is separated from center conductor 102 by a first insulating layer 110. Similarly, outer conductor 106 is concentric with middle conductor 104 (as well as center conductor 102) and is separated from middle conductor 104 by second insulating layer 112. Exterior sheath 114 surrounds and protects outer conductor 106.

In use, outer conductor 106 of triaxial cable 100 may be grounded to shield center conductor 102 of triaxial cable 100 from external noise. Also, middle conductor 104 of triaxial cable 100 may be driven to the same potential as center conductor 102 of triaxial cable 100 to reduce or essentially eliminate leakage currents between middle conductor 104 and center conductor 102. Unlike triaxial cable 100, coaxial cable lacks a middle conductor 104, so triaxial cable 100 may achieve reduced cabling noise, leakage currents, and cabling capacitance compared to coaxial cable.

Adapter 10 includes a female triaxial connector 12, as illustrated schematically in FIG. 1. An exemplary triaxial connector is the BNC Style Bulkhead Mount Triaxial Connector (Model 5219) generally available from Pomona Electronics of Everett, Wash. Triaxial connector 12 includes center connector portion 14, middle connector portion 16, and outer connector portion 18. Triaxial connecter 12 is configured to receive triaxial cable 100 such that center connector portion 14 of triaxial connector 12 is in electrical communication with center conductor 102 of triaxial cable 100, middle connector portion 16 of triaxial connector 12 is in electrical communication with middle conductor 104 of triaxial cable 100, and outer connector portion 18 of triaxial connector 12 is in electrical communication with outer conductor 106 of triaxial cable 100. In the illustrated embodiment of FIG. 2, triaxial connector 12 is coupled to a first printed circuit board 20.

Adapter 10 further includes multiple male single-conductor connectors such as banana plugs, as illustrated schematically in FIG. 1. More particularly, adapter 10 includes core banana plug 30, guard banana plug 32, and ground banana plug 34. An exemplary banana plug is the Bulkhead Mount Banana Plug manufactured by SPC Technology of Chicago, Ill. and generally available from Newark of Chicago, Ill. Known banana plugs include a cylindrical metal pin having a length of about 25 millimeters and a diameter of about 4 millimeters. Generally, banana plugs also include at least one spring that forces the metal pin radially outwardly to contact a receiving banana jack terminal. As shown in FIG. 1, core banana plug 30 is in electrical communication with center connector portion 14 of triaxial connector 12 via conductive pathway 42*a*, guard banana plug 32 is in electrical communication with middle connector portion 16 of triaxial connector 12 via conductive pathway 42*b*, and ground banana plug 34 is in electrical communication with outer connector portion 18 of triaxial connector 12 via conductive pathway 42*c*. In the illustrated embodiment of FIG. 3, core banana plug 30, guard banana plug 32, and ground banana plug 34 are coupled to a second printed circuit board 36.

With triaxial cable 100 coupled to triaxial connector 12 of adapter 10, triaxial cable 100 is in electrical communication with banana plugs 30, 32, 34, of adapter 10. More particularly, and as shown in FIG. 1, center conductor 102 of triaxial cable 100 is in electrical communication with core banana plug 30 via conductive pathway 42*a*, middle conductor 104 of triaxial cable 100 is in electrical communication with guard banana plug 32 via conductive pathway 42*b*, and outer conductor 106 of triaxial cable 100 is in electrical communication with ground banana plug 34 via conductive pathway 42*c*.

Figure 4:
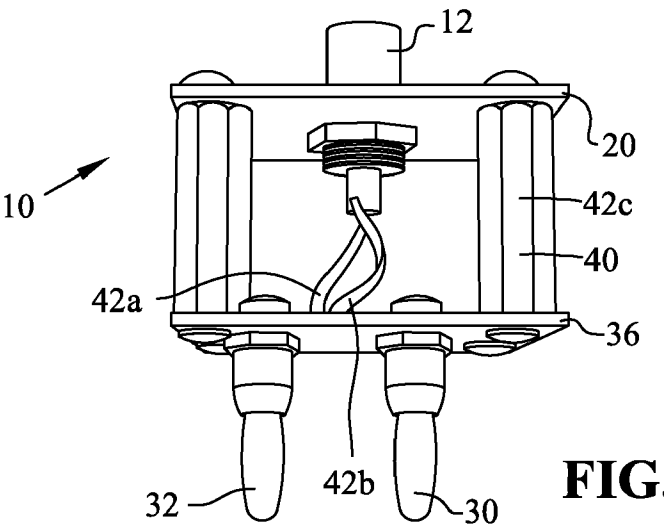
FIG. 4 is a perspective view of an illustrative adapter of the present disclosure, including the first printed circuit board of FIG. 2 and the second printed circuit board of FIG. 3.

As shown in FIG. 4, first printed circuit board 20 of adapter 10 is stacked atop second printed circuit board 36 of adapter 10. In this arrangement, triaxial connector 12 on first printed circuit board 20 substantially overlaps and extends substantially parallel to core banana plug 30, guard banana plug 32, and ground banana plug 34 on second printed circuit board 36. First printed circuit board 20 may be spaced apart from second printed circuit board 36 by approximately ⅛", ¼", ½", or more using, for example, a plurality of appropriately sized standoffs 40. Advantageously, in this stacked arrangement, adapter 10 has a minimum length and width to avoid interfering with adjacent electrical components. For example, first and second printed circuit boards 20, 36, of adapter 10 may have a length and a width of approximately 1.75".

Figure 3:
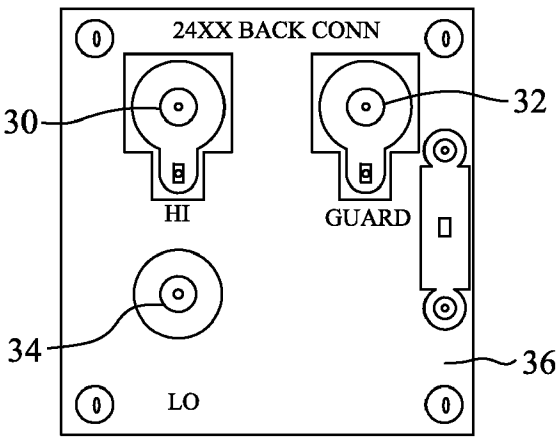
FIG. 3 is a plan view of a second printed circuit board having a plurality of banana plugs.
Figure 2:
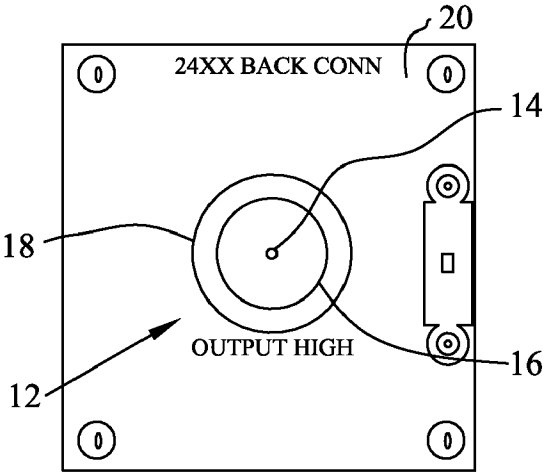
FIG. 2 is a plan view of a first printed circuit board having a triaxial connector.

The conductive pathways 42*a*, 42*b*, 42*c*, that couple triaxial connector 12 and banana plugs 30, 32, 34, may include insulated wires that extend between first printed circuit board 20 and second printed circuit board 36 of adapter 10, as shown in FIG. 4. According to an exemplary embodiment of the present disclosure, the insulated wires are approximately 20 gauge wires, 15 gauge wires, 10 gauge wires, or larger wires, for example. It is within the scope of the present disclosure that, rather than providing an insulated wire for conductive pathway 42*c*, conductive pathway 42*c* may extend through a conductive standoff 40 (e.g. aluminum). More particularly, outer connector portion 18 of triaxial connector 12 may be provided in direct contact with metallization on first printed circuit board 20, as shown in FIG. 2, and ground banana plug 34 may be provided in direct contact with metallization on second printed circuit board 36, as shown in FIG. 3, such that conductive pathway 42*c* travels from outer connector portion 18 of triaxial connector 12, through metallization on first printed circuit board 20, through standoffs 40, through metallization on second printed circuit board 36, and to ground banana plug 34. Alternatively, it is within the scope of the present disclosure that triaxial connector 12 and banana plugs 30, 32, 34, may extend from a single printed circuit board such that the conductive pathways are printed into the single circuit board.

Adapter 10 may be provided with an exterior housing or shield (not shown) to protect adapter 10 and to minimize interference with adapter 10. An exemplary housing includes an electromagnetic interference (EMI)/radio frequency interference (RFI) shield. The housing would also serve as a common shield or connection to outer conductor 106 (FIG. 1).

Figure 5:
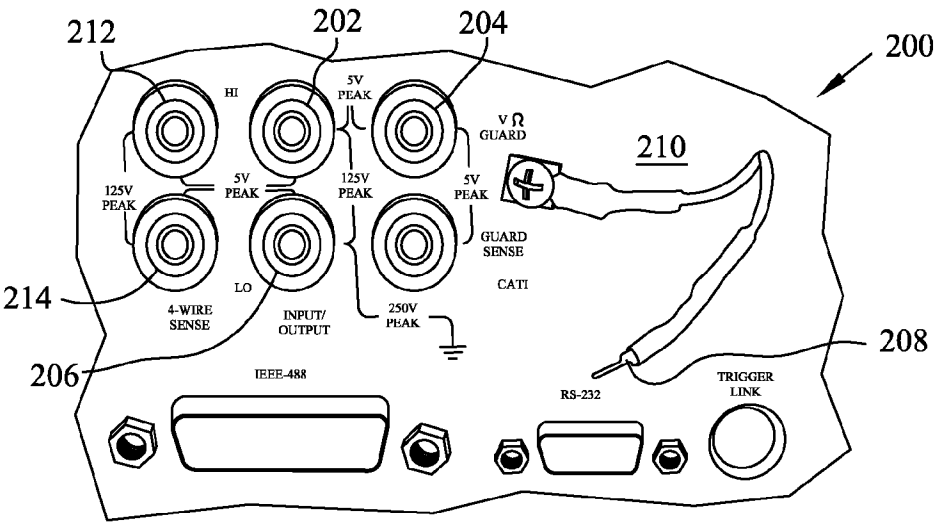
FIG. 5 is a partial perspective view of a source measurement unit.

Referring next to FIG. 5, an illustrative electronic testing device, such as source measurement unit (SMU) 200, is provided. An exemplary SMU 200 is able to provide precise voltage sourcing and current. Also, an exemplary SMU 200 is able to monitor voltage and current consumed. Such SMU's are generally available from Keithley Instruments, Inc. of Cleveland, Ohio (including Model 2400, Model 2410, and Model 2430) and Agilent Technologies, Inc. of Santa Clara, Calif., for example. In the illustrated embodiment of FIG. 5, SMU 200 includes a plurality of banana jack terminals. More particularly, SMU 200 includes an INPUT/OUTPUT HI banana jack terminal 202, a driven INPUT/OUTPUT GUARD banana jack terminal 204, and an INPUT/OUTPUT LO banana jack terminal 206. For purposes of the present disclosure, DUT 300 may be any device that is capable of maintaining the INPUT/OUTPUT HI banana jack terminal 202 and the INPUT/OUTPUT GUARD banana jack terminal 204 at the same voltage. In certain embodiments, adjacent banana jack terminals of SMU 200 may be separated by a standard distance, such as approximately ¾". SMU 200 further includes a female grounding pin 208 that is grounded to chassis 210 of SMU 200. An exemplary grounding pin is generally available from Cambion Electronic Components of Hope Valley, United Kingdom.

Figure 6:
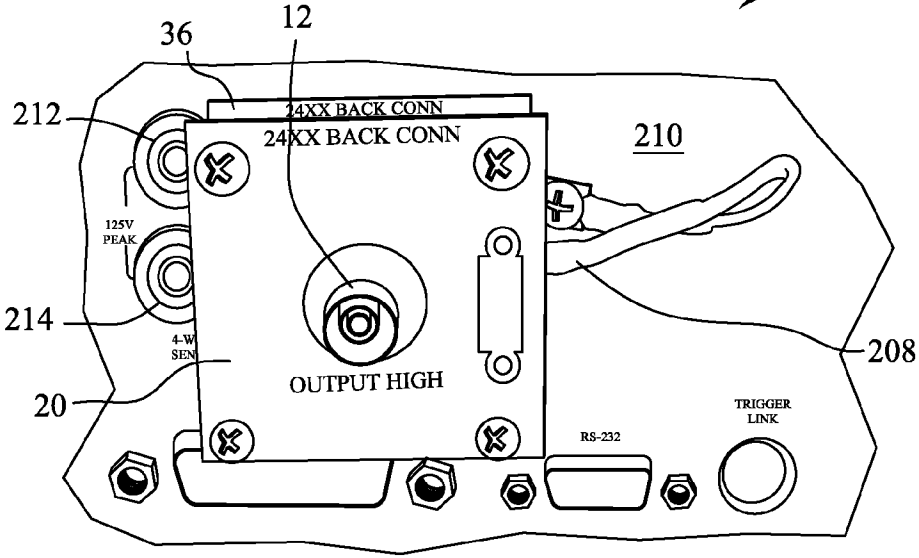
FIG. 6 is a perspective view of the adapter of FIG. 4 connected to the source measurement unit of FIG. 5.

In use, adapter 10 electrically connects DUT 300 of FIG. 1 to SMU 200 of FIG. 5. For example, DUT 300 of FIG. 1 may be connected to SMU 200 of FIG. 5 to develop, analyze, and test DUT 300. For purposes of the present disclosure, DUT 300 may be any device having a triaxial cable 100. Banana plugs 30, 32, 34, of adapter 10 may be inserted into banana jack terminals 202, 204, 206, of SMU 200, respectively, as shown in FIG. 6. With triaxial cable 100 coupled to adapter 10, center conductor 102 of triaxial cable 100 is in electrical communication with the INPUT/OUTPUT HI banana jack terminal 202 via core banana plug 30 of adapter 10, middle conductor 104 of triaxial cable 100 is in electrical communication with the driven INPUT/OUTPUT GUARD banana jack terminal 204 via guard banana plug 32 of adapter 10, and outer conductor 106 of triaxial cable 100 is in electrical communication with the INPUT/OUTPUT LO banana jack terminal 206 via ground banana plug 34 of adapter 10. In this embodiment, SMU 200 is able to force a test current through center conductor 102 of triaxial cable 100 while driving middle conductor 104 of triaxial cable 100 to the same potential as center conductor 102, thereby reducing or essentially eliminating leakage currents between middle conductor 104 and center conductor 102 during testing.

As shown in FIG. 6, grounding pin 208 of SMU 200 is coupled to second printed circuit board 36 of adapter 10. In this embodiment, ground banana plug 34 of adapter 10 is grounded to chassis 210 of SMU 200 via second printed circuit board 36 to shield center conductor 102 of triaxial cable 100 from external noise during testing.

According to an exemplary embodiment of the present disclosure, core banana plug 30, guard banana plug 32, and ground banana plug 34 of adapter 10 are arranged on second printed circuit board 36 to accommodate a standard SMU 200. For example, core banana plug 30, guard banana plug 32, and ground banana plug 34 of adapter 10 may be separated by approximately ¾" to mimic the spacing between the INPUT/OUTPUT HI banana jack terminal 202, the INPUT/OUTPUT GUARD banana jack terminal 204, and the INPUT/OUTPUT LO banana jack terminal 206 of SMU 200.

Figure 7:
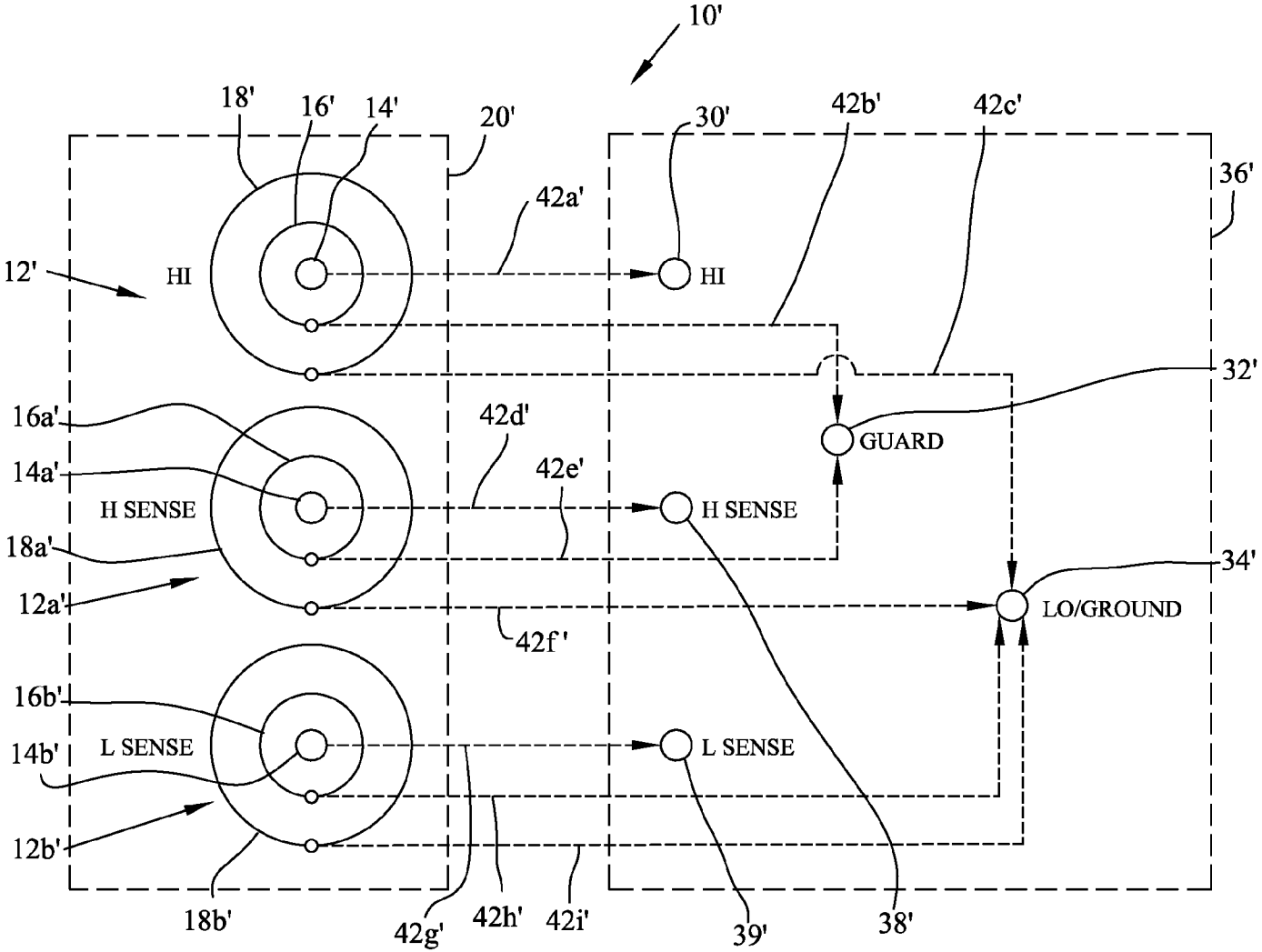
FIG. 7 is a schematic diagram of another illustrative adapter of the present disclosure.

Referring next to FIG. 7, another illustrative adapter 10' is provided for use with DUT 300 having a triaxial (or triax) cable 100 (FIG. 1). Adapter 10' is also configured for remote sensing. Remote sensing is used to sense voltage across DUT 300, allowing SMU 200 to measure and compensate for losses in the test circuit. Adapter 10' is substantially similar to adapter 10 of FIGS. 1-6, except as described below.

Adapter 10' includes a plurality of female triaxial connectors. More particularly, and as illustrated schematically in FIG. 7, adapter 10' includes force triaxial connector 12', high sensing triaxial connector 12*a*', and low sensing triaxial connector 12*b*'. Each triaxial connector 12', 12*a*', 12*b*', includes center connector portion 14', 14*a*', 14*b*', middle connector portion 16', 16*a*', 16*b*', and outer connector portion 18', 18*a*', 18*b*', respectively. Thus, each triaxial connector 12', 12*a*', 12*b*', of adapter 10' is configured to receive a triaxial cable, such as triaxial cable 100 of FIG. 1. More particularly, force triaxial connector 12' is configured to receive a forced triaxial cable (not shown), high sensing triaxial connector 12*a*' is configured to receive a high sensing triaxial cable (not shown), and low sensing triaxial connector 12*b*' is configured to receive a low sensing triaxial cable (not shown). As discussed above with respect to triaxial connector 12, the various triaxial cables will be arranged in electrical communication with center connector portions 14', 14*a*', 14*b*', middle connector portions 16', 16*a*', 16*b*', and outer connector portions 18', 18*a*', 18*b*', of triaxial connectors 12', 12*a*', 12*b*'. In the illustrated embodiment of FIG. 8, triaxial connectors 12', 12*a*', 12*b*', are coupled to a first printed circuit board 20'.

Adapter 10' further includes multiple male banana plugs, as illustrated schematically in FIG. 7. More particularly, and like adapter 10, adapter 10' includes core banana plug 30', guard banana plug 32', and ground banana plug 34'. Unlike adapter 10, adapter 10' further includes high sensing banana plug 38' and low sensing banana plug 39'. As shown in FIG. 7, banana plugs 30', 32', 34', 38', 39', are in electrical communication with triaxial connectors 12', 12*a*', 12*b*'. More particularly, the illustrated connections of FIG. 7 are as follows: core banana plug 30' is in electrical communication with center connector portion 14' of force triaxial connector 12' via conductive pathway 42*a*'; guard banana plug 32' is in electrical communication with middle connector portion 16' of force triaxial connector 12' via conductive pathway 42*b*', as well as middle connector portion 16*a*' of high sensing triaxial connector 12*a*' via conductive pathway 42*e*'; ground banana plug 34' is in electrical communication with outer connector portion 18' of force triaxial connector 12' via conductive pathway 42*c*', outer connector portion 18*a*' of high sensing triaxial connector 12*a*' via conductive pathway 42*f*', middle connector portion 16*b*' of low sensing triaxial connector 12*b*' via conductive pathway 42*h*', and outer connector portion 18*b*' of low sensing triaxial connector 12*b*' via conductive pathway 42*i*'; high sensing banana plug 38' is in electrical communication with center connector portion 14*a*' of high sensing triaxial connector 12*a*' via conductive pathway 42*d*'; and low sensing banana plug 39' is in electrical communication with center connector portion 14*b*' of low sensing triaxial connector 12*b*' via conductive pathway 42*g*'. In the illustrated embodiment of FIG. 9, banana plugs 30', 32', 34', 38', 39', are coupled to a second printed circuit board 36'.

With a forced triaxial cable (not shown), a high sensing triaxial cable (not shown), and a low sensing triaxial cable (not shown) coupled to triaxial connectors 12', 12*a*', 12*b*', of adapter 10', respectively, the various triaxial cables are in electrical communication with banana plugs 30', 32', 34', 38', 39', of adapter 10'.

Figure 10:
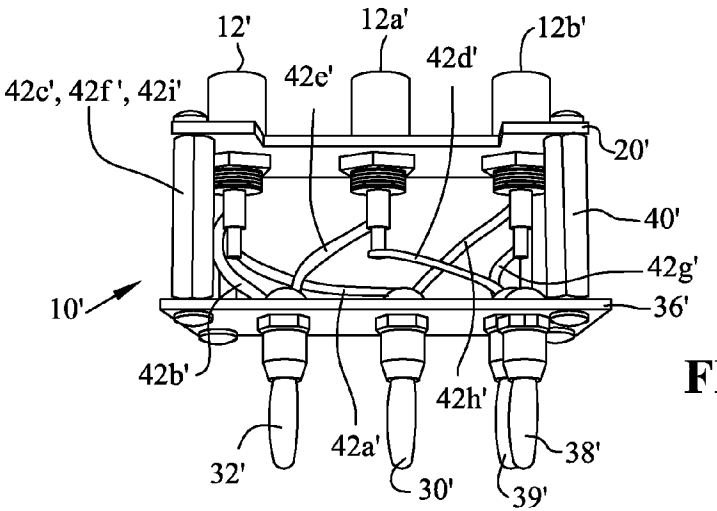
FIG. 10 is a perspective view of another illustrative adapter of the present disclosure, including the first printed circuit board of FIG. 8 and the second printed circuit board of FIG. 9.

As shown in FIG. 10, first printed circuit board 20' of adapter 10' is stacked atop second printed circuit board 36' of adapter 10'. In this arrangement, triaxial connectors 12', 12*a*', 12*b*', on first printed circuit board 20 substantially overlap and extend substantially parallel to banana plugs 30', 32', 34', 38', 39', on second printed circuit board 36'. First printed circuit board 20' may be spaced apart from second printed circuit board 36' by approximately ⅛", ¼", ½", or more using, for example, a plurality of appropriately sized standoffs 40'. Advantageously, in this stacked arrangement, adapter 10' has a minimum length and width to avoid interfering with adjacent electrical components. For example, first and second printed circuit boards 20', 36', of adapter 10' may have a length of approximately 1.75" and a width of approximately 2.5".

Figure 8:
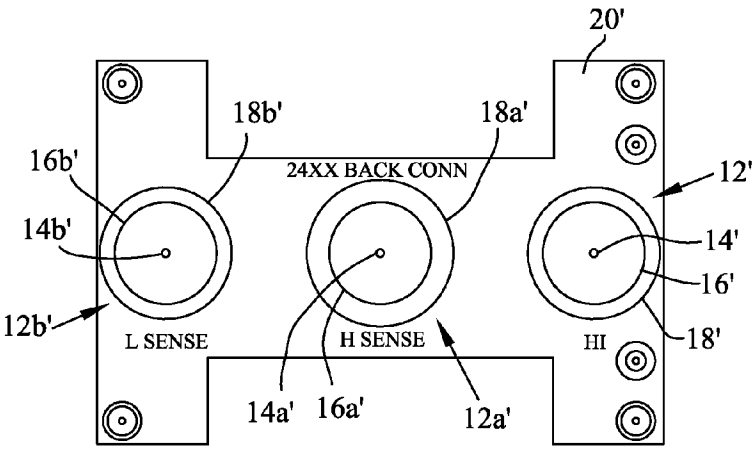
FIG. 8 is a plan view of a first printed circuit board having a plurality of triaxial connectors.
Figure 9:
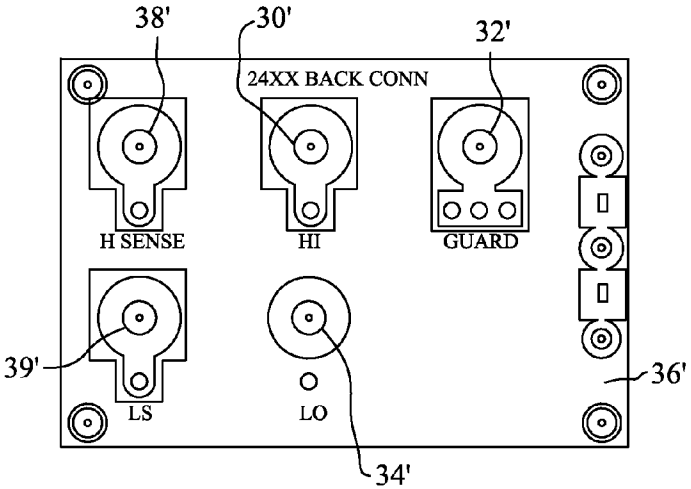
FIG. 9 is a plan view of a second printed circuit board having a plurality of banana plugs.

The conductive pathways 42*a*', 42*b*', 42*c*', 42*d*', 42*e*', 42*f*', 42*g*', 42*h*', 42*i*', that couple triaxial connectors 12', 12*a*', 12*b*', and banana plugs 30', 32', 34', 38', 39', may include insulated wires that extend between first printed circuit board 20' and second printed circuit board 36' of adapter 10', as shown in FIG. 10. According to an exemplary embodiment of the present disclosure, the insulated wires are approximately 20 gauge wires, 15 gauge wires, 10 gauge wires, or larger wires, for example. It is within the scope of the present disclosure that, rather than providing insulated wires for conductive pathways 42*c*', 42*f*', 42*i*', conductive pathways 42*c*', 42*f*', 42*i*', may extend through a conductive standoff 40' (e.g. aluminum). More particularly, outer connector portions 18', 18*a*',

18*b*', of triaxial connectors 12', 12*a*', 12*b*', may be provided in direct contact with metallization on first printed circuit board 20', as shown in FIG. 8, and ground banana plug 34' may be provided in direct contact with metallization on second printed circuit board 36', as shown in FIG. 9, such that conductive pathways 42*c*', 42*f*, 42*i*', travel from outer connector portions 18', 18*a*', 18*b*', of triaxial connectors 12', 12*a*', 12*b*', through metallization on first printed circuit board 20', through standoffs 40', through metallization on second printed circuit board 36', and to ground banana plug 34'. Alternatively, it is within the scope of the present disclosure that triaxial connectors 12', 12*a*', 12*b*', and banana plugs 30', 32', 34', 38', 39', may extend from a single printed circuit board such that the conductive pathways are printed into the single circuit board.

Like adapter 10, adapter 10' may be provided with an exterior housing or shield (not shown) to protect adapter 10' and to minimize interference with adapter 10'. An exemplary housing includes an electromagnetic interference (EMI)/radio frequency interference (RFI) shield.

Referring next to FIG. 11, SMU 200 is once again illustrated. As discussed above with respect to FIG. 5, SMU 200 includes the INPUT/OUTPUT HI banana jack terminal 202, the driven INPUT/OUTPUT GUARD banana jack terminal 204, and the INPUT/OUTPUT LO banana jack terminal 206. SMU 200 also includes a 4-WIRE SENSE HI banana jack terminal 212 and a 4-WIRE SENSE LO banana jack terminal 214. SMU 200 further includes a female grounding pin 208 that is grounded to chassis 210 of SMU 200.

Figure 11:
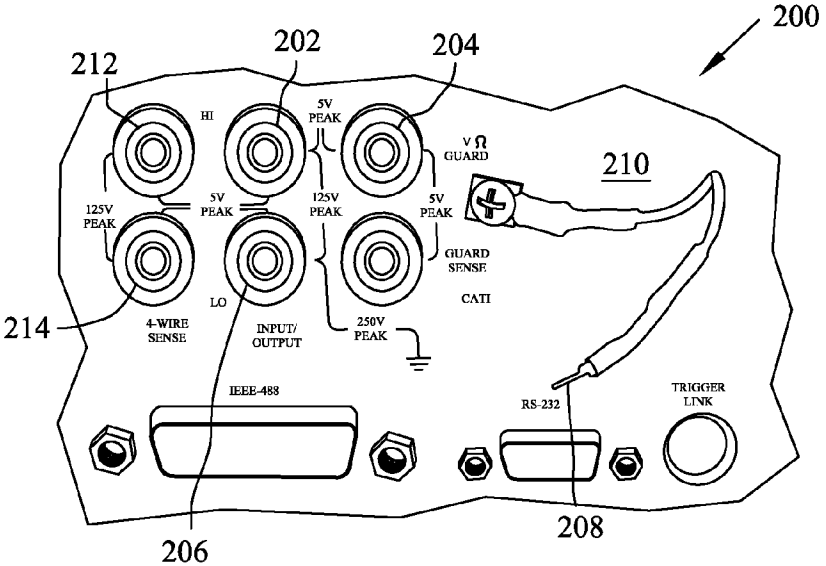
FIG. 11 is a partial perspective view similar to FIG. 5 of a source measurement unit.
Figure 12:
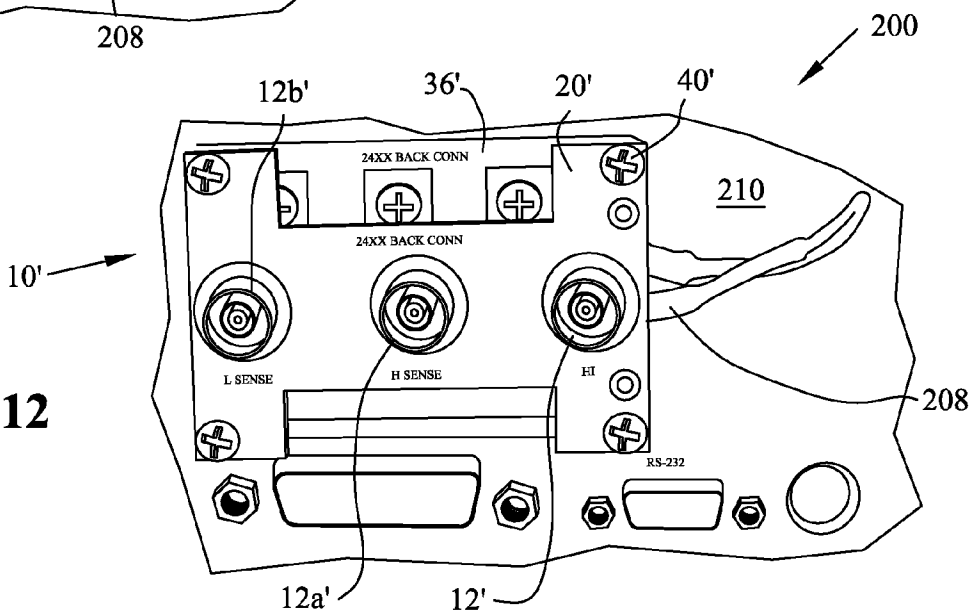
FIG. 12 is a perspective view of the adapter of FIG. 10 connected to the source measurement unit of FIG. 11.

In use, adapter 10' electrically connects DUT 300 of FIG. 1 to SMU 200 of FIG. 11. Banana plugs 30', 32', 34', 38', 39', of adapter 10' may be inserted into banana jack terminals 202, 204, 206, 212, 214, of SMU 200, respectively, as shown in FIG. 12. In this embodiment, SMU 200 is able to force a test current through the center conductor of the force triaxial cable (not shown) while driving the middle conductor of the force triaxial cable (not shown) to the same potential as the inner conductor, thereby reducing or essentially eliminating leakage currents between the middle conductor and the center conductor during testing. Also, SMU 200 is able to conduct remote sensing and measure voltage across DUT 300 through the high sensing triaxial cable (not shown) and/or the low sensing triaxial cable (not shown), both having driven middle or guard conductors like the force triaxial cable (not shown).

As shown in FIG. 12, grounding pin 208 of SMU 200 is coupled to second printed circuit board 36' of adapter 10'. In this embodiment, ground banana plug 34' of adapter 10' is grounded to chassis 210 of SMU 200 via second printed circuit board 36' to shield the force triaxial cable (not shown), the high sensing triaxial cable (not shown), and the low sensing triaxial cable (not shown) from external noise during testing.

According to an exemplary embodiment of the present disclosure, banana plugs 30', 32', 34', 38', 39', of adapter 10' are arranged on second printed circuit board 36' to accommodate a standard SMU 200. For example, adjacent banana plugs 30', 32', 34', 38', 39', of adapter 10' may be separated by approximately ¾" to mimic the spacing between the INPUT/OUTPUT HI banana jack terminal 202, the INPUT/OUTPUT GUARD banana jack terminal 204, the INPUT/OUTPUT LO banana jack terminal 206, the 4-WIRE SENSE HI banana jack terminal 212, and the 4-WIRE SENSE LO banana jack terminal 214 of SMU 200.

It is within the scope of the present invention that the male and female components described above may be reversed. For example, adapters 10 and 10' may include female banana jacks and SMU 200 may include male banana plugs.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An adapter for use with a triaxial cable having a center conductor, a middle conductor that surrounds the center conductor, and an outer conductor that surrounds the middle conductor, the adapter including:

a triaxial connector including a center connector portion, a middle connector portion, and an outer connector portion, the triaxial connector configured to couple to the triaxial cable such that the center connector portion is in electrical communication with the center conductor of the triaxial cable, the middle connector portion is in electrical communication with the middle conductor of the triaxial cable, and the outer connector portion is in electrical communication with the outer conductor of the triaxial cable;

a first single-conductor connector in electrical communication with the center connector portion of the triaxial connector, the first single-conductor connector configured to provide the center conductor of the triaxial cable at a potential; and a second single-conductor connector in electrical communication with the middle connector portion of the triaxial connector, the second single-conductor connector configured to provide the middle conductor of the triaxial cable at the same potential as the center conductor of the triaxial cable.

2. The adapter of claim 1, wherein the triaxial connector is axially spaced apart from the first and second single-conductor connectors.

3. The adapter of claim 1, wherein the center connector portion and the middle connector portion of the triaxial connector are concentric and the first and second single-conductor connectors are eccentric.

4. The adapter of claim 1, wherein the first and second single-conductor connectors include banana connectors.

5. The adapter of claim 4, wherein the banana connectors are separated by approximately ¾".

6. The adapter of claim 1, wherein the triaxial connector is a female component and the first and second single-conductor connectors are male components.

7. The adapter of claim 1, further including a third single-conductor connector in electrical communication with the outer connector portion of the triaxial connector.

8. The adapter of claim 1, further including means for grounding the outer conductor of the triaxial cable.

9. The adapter of claim 1, further including a second triaxial connector configured to couple to a second triaxial cable, wherein the second single-conductor connector is in electrical communication with both triaxial connectors.

10. The adapter of claim 9, further including a fourth single-conductor connector in electrical communication with the second triaxial connector to provide remote sensing.

11. The adapter of claim 10, further including a third triaxial connector and a fifth single-conductor connector in electrical communication with the third triaxial connector to provide remote sensing.

12. A system for use with a triaxial cable having a center conductor, a middle conductor that surrounds the center conductor, and an outer conductor that surrounds the middle conductor, the system including:

an electronic device including a first banana jack terminal and a second banana jack terminal, the electronic device configured to drive the first and second banana jack terminals to the same potential; and an adapter including a first banana plug and a second banana plug, the adapter configured to couple to the triaxial cable and to the electronic device such that the center conductor of the triaxial cable is in electrical communication with the first banana jack terminal of the electronic device via the first banana plug and the middle conductor of the triaxial cable is in electrical communication with the second banana jack terminal of the electronic device via the second banana plug such that electronic device is configured to drive the center conductor and the middle conductor of the triaxial cable to the same potential.

13. The system of claim 12, wherein the adapter further includes a connector having at least a center connector portion and a middle connector portion, the connector configured to receive the triaxial cable such that the center connector portion is in electrical communication with the center conductor of the triaxial cable and the first banana plug and the middle connector portion is in electrical communication with the middle conductor of the triaxial cable and the second banana plug.

14. The system of claim 13, further comprising the triaxial cable, the triaxial cable received within the connector of the adapter and the adapter coupled to the electronic device such that the center conductor of the triaxial cable is in electrical communication with the first banana jack terminal of the electronic device via the first banana plug and the middle conductor of the triaxial cable is in electrical communication with the second banana jack terminal of the electronic device via the second banana plug.

15. The system of claim 12, wherein the electronic device includes a source measurement unit.

16. The system of claim 12, wherein the first and second banana jack terminals of the electronic device and the first and second banana plugs of the adapter are separated by the same distance.

17. The system of claim 12, wherein the electronic device further includes a grounded component and the adapter is configured to couple the outer conductor of the triaxial cable to the grounded component of the electronic device.

18. The system of claim 12, wherein the electronic device further includes a third banana jack terminal and the adapter further includes a third banana plug, the adapter configured to couple to a second triaxial cable and to the electronic device such that the second triaxial cable is in electrical communication with both the second and third banana jack terminals of the electronic device via the second and third banana plugs, respectively, to provide remote sensing.

19. The system of claim 18, wherein the electronic device further includes a fourth banana jack terminal and the adapter further includes a fourth banana plug, the adapter configured to couple to a third triaxial cable and to the electronic device such that the third triaxial cable is in electrical communication with the fourth banana jack terminal of the electronic device via the fourth banana plug to provide remote sensing.

20. The system of claim 19, wherein the adapter further includes a fifth banana plug configured to electrically communicate with the triaxial cable, the second triaxial cable, and the third triaxial cable.

21. A method for connecting electrical components using a triaxial cable, the triaxial cable having a center conductor, a middle conductor that surrounds the center conductor, and an outer conductor that surrounds the middle conductor, the method including the steps of:

providing an adapter including a first banana connector and a second banana connector;

connecting the triaxial cable to the adapter such that the center conductor of the triaxial cable is in electrical communication with the first banana connector of the adapter and the middle conductor of the triaxial cable is in electrical communication with the second banana connector of the adapter;

providing an electronic device including a first banana terminal and a second banana terminal; and connecting the adapter to the electronic device such that the first banana connector of the adapter is in electrical communication with the first banana terminal of the electronic device and the second banana connector of the adapter is in electrical communication with the second banana terminal of the electronic device.

22. The method of claim 21, further including the step of connecting a second triaxial cable to the adapter to detect voltage across a test device.

23. The method of claim 22, wherein the step of connecting the second triaxial cable to the adapter includes placing a second center conductor of the second triaxial cable in electrical communication with a third banana terminal of the electronic device and a second middle conductor of the second triaxial cable in electrical communication with the second banana terminal of the electronic device.

24. The method of claim 21, further including the step of maintaining the first and second banana terminals of the electronic device at the same voltage to maintain the center conductor and the middle conductor of the triaxial cable at the same voltage.

25. The method of claim 21, further including the step of grounding the outer conductor of the triaxial cable.

* * * * *